US012473804B2

(12) United States Patent
Lu et al.

(10) Patent No.: US 12,473,804 B2
(45) Date of Patent: Nov. 18, 2025

(54) EXTERNAL RECIRCULATION FOR GAS LOCK RELIEF

(71) Applicant: Baker Hughes Oilfield Operations LLC, Houston, TX (US)

(72) Inventors: Xiaonan Lu, Houston, TX (US); Zheng Ye, Houston, TX (US); Rissa Rutter, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/221,298

(22) Filed: Jul. 12, 2023

(65) Prior Publication Data

US 2024/0018855 A1 Jan. 18, 2024

Related U.S. Application Data

(60) Provisional application No. 63/388,508, filed on Jul. 12, 2022.

(51) Int. Cl.

| | |
|---|---|
| ***E21B 43/12*** | (2006.01) |
| ***E21B 34/08*** | (2006.01) |
| ***E21B 43/38*** | (2006.01) |
| ***F04B 47/06*** | (2006.01) |

(52) U.S. Cl.

CPC ..... *E21B 43/128* (2013.01); *E21B 34/08* (2013.01); *E21B 43/38* (2013.01); *F04B 47/06* (2013.01)

(58) Field of Classification Search

CPC ..... E21B 43/128; E21B 43/121; E21B 43/12; E21B 43/38; E21B 43/34; E21B 34/08; F04B 47/06; F04D 9/001; F04D 13/10; F04D 13/086

See application file for complete search history.

(56) References Cited

U.S. PATENT DOCUMENTS

| | | | |
|---|---|---|---|
| 2,355,259 | A | 8/1944 | Cotesworth et al. |
| 2,929,501 | A | 3/1960 | Fenske et al. |
| 3,986,552 | A | 10/1976 | Scott |
| 4,253,481 | A | 3/1981 | Sarlls |
| 5,207,810 | A | 5/1993 | Sheth |

(Continued)

FOREIGN PATENT DOCUMENTS

| | | | |
|---|---|---|---|
| CN | 108386160 | A | 8/2018 |
| GB | 2365046 | A | 2/2002 |
| WO | 2012169904 | A2 | 12/2012 |

OTHER PUBLICATIONS

International Search Report and Written Opinion for PCT/US2023/27565 mailed Oct. 5, 2023.

*Primary Examiner* — George S Gray
(74) *Attorney, Agent, or Firm* — Baker Hughes Company

(57) ABSTRACT

A submersible pumping system for producing a fluid from a wellbore through production tubing to a wellhead includes a pump assembly that has at least one pump, a motor that drives the at least one pump, and a recirculation module. The recirculation module includes a recirculation mandrel positioned within the production tubing and a recirculation line extending from the recirculation valve to the pump assembly. The recirculation module delivers a volume of priming fluid from the production tubing to the pump assembly. In some embodiments, the recirculation module further includes a recirculation valve, which can be positioned in an offset relationship from the recirculation mandrel.

4 Claims, 7 Drawing Sheets

(56) References Cited

U.S. PATENT DOCUMENTS 5,271,725 A 12/1993 Freet et al.
5,344,269 A 9/1994 Banks
5,433,269 A 7/1995 Hendrickson
5,553,669 A 9/1996 Trainer
5,660,533 A 8/1997 Cartwright
5,845,709 A 12/1998 Mack et al.
6,126,416 A 10/2000 Lee
6,186,227 B1 2/2001 Vaynshteyn et al.
6,260,627 B1 * 7/2001 Rivas ..... E21B 43/128 166/369
6,315,050 B2 11/2001 Vaynshteyn et al.
6,564,876 B2 5/2003 Vaynshteyn et al.
6,684,946 B2 2/2004 Gay et al.
6,899,176 B2 5/2005 Hailey et al.
7,357,186 B1 4/2008 Berry
7,387,158 B2 6/2008 Murray et al.
7,461,692 B1 12/2008 Wang
7,462,225 B1 12/2008 Ketter et al.
7,552,777 B2 6/2009 Murray et al.
7,713,035 B2 5/2010 Ford
7,841,395 B2 11/2010 Gay et al.
8,322,450 B2 12/2012 Meijer
8,584,744 B2 11/2013 Soni et al.
8,998,586 B2 4/2015 Muhs
9,283,497 B2 3/2016 Wang et al.
9,447,661 B2 9/2016 Broussard et al.
9,447,788 B2 9/2016 Henry et al.
9,624,930 B2 4/2017 Gahlot et al.
10,167,708 B2 1/2019 Beveridge
10,344,580 B2 7/2019 Williams
11,098,570 B2 8/2021 De et al.
2002/0023750 A1 2/2002 Lopes et al.
2003/0192702 A1 * 10/2003 Gay ..... E21B 34/08 166/373
2004/0020638 A1 2/2004 Williams
2004/0129432 A1 7/2004 Wills et al.
2004/0131488 A1 7/2004 Locher
2005/0199551 A1 9/2005 Gordon
2005/0281683 A1 12/2005 Brown et al.
2008/0093085 A1 4/2008 Knight et al.
2008/0110614 A1 5/2008 Orban
2009/0065202 A1 3/2009 Brown et al.
2009/0159262 A1 * 6/2009 Gay ..... E21B 43/128 166/105
2009/0178803 A1 * 7/2009 Neuroth ..... F04D 13/10 166/62
2010/0175869 A1 7/2010 Cobb
2010/0206732 A1 8/2010 Hale
2011/0024119 A1 2/2011 Wolf et al.
2011/0180272 A1 7/2011 Head
2012/0057965 A1 3/2012 Bergamini et al.
2013/0025865 A1 1/2013 Knobloch et al.
2013/0068455 A1 3/2013 Brown et al.
2013/0075105 A1 3/2013 Morton
2013/0306330 A1 11/2013 Bishop et al.
2014/0332239 A1 11/2014 Porta
2015/0053394 A1 2/2015 Reid et al.
2015/0075772 A1 3/2015 Saponja et al.
2015/0098840 A1 4/2015 Kowalchuk
2015/0167652 A1 6/2015 Van et al.
2015/0204158 A1 7/2015 Frisby et al.
2015/0205158 A1 7/2015 Engel et al.
2015/0275619 A1 10/2015 Slup
2015/0345276 A1 12/2015 Jensen
2016/0003031 A1 1/2016 Xin et al.
2016/0130919 A1 5/2016 Vasques
2016/0222770 A1 8/2016 Kirk et al.
2017/0175468 A1 6/2017 Vail, III et al.
2017/0241215 A1 8/2017 Kleppa
2017/0292361 A1 10/2017 Beauquin et al.
2017/0342798 A1 11/2017 Wutherich
2018/0112509 A1 4/2018 Saponja et al.
2018/0171763 A1 6/2018 Malbrel et al.
2018/0179852 A1 6/2018 Hou et al.
2018/0223642 A1 8/2018 Zahran
2018/0298736 A1 10/2018 Bailey et al.
2019/0292893 A1 9/2019 El-Mahbes et al.
2020/0032612 A1 1/2020 Joshi et al.
2020/0165908 A1 5/2020 El-Mahbes et al.
2020/0362683 A1 11/2020 El Mahbes et al.
2020/0378235 A1 12/2020 Gonzales et al.
2021/0148380 A1 * 5/2021 Brown ..... F04D 29/708
2021/0310352 A1 10/2021 Pelletier et al.

* cited by examiner

EXTERNAL RECIRCULATION FOR GAS LOCK RELIEF

RELATED APPLICATIONS

The present application claims the benefit of U.S. Provisional Patent Application Ser. No. 63/388,508 filed Jul. 12, 2022 entitled, "Improved External Recirculation for Gas Lock Relief," the disclosure of which is herein incorporated by reference.

FIELD OF THE INVENTION

This invention relates generally to the field of downhole pumping systems, and more particularly to systems and methods for alleviating gas lock in submersible pumping systems.

BACKGROUND

Submersible pumping systems are often deployed into wells to recover petroleum fluids from subterranean reservoirs. Typically, a submersible pumping system includes a number of components, including an electric motor coupled to one or more pump assemblies. Production tubing is connected to the pump assemblies to deliver the wellbore fluids from the subterranean reservoir to a storage facility on the surface. In many cases, the pump assemblies are multistage centrifugal pumps that include a plurality of stages, with each stage including a stationary diffuser and a rotary impeller that is connected to a shaft driven by the electric motor.

Wellbore fluids often contain a combination of liquids and gases. Because most downhole pumping equipment is primarily designed to recover liquids, excess amounts of gas in the wellbore fluid can present problems for downhole equipment. For the centrifugal pump to operate, the pump must maintain its "prime," in which fluid is located in and around the "eye," or central intake portion, of the first impeller of the pump or gas separator. If, for example, a gas slug moves through the well to the pump intake, the pump may lose its prime and will thereafter be unable to pump liquids while gas remains around the eye of the impeller.

The pump can be re-primed by moving fluids to the intake for the first impeller. Once the impeller is provided with a sufficient volume of liquid to displace the trapped gas, the pump will begin pumping against to clear the gas slug through the pump. While it is known in the art to provide self-priming centrifugal pumps, many of these rely on a fluid storage chamber or reservoir to provide fluid for re-priming. Other self-priming pumps rely on recirculation valves within the pump or production tubing to divert fluids to the pump intake in the event the pump loses prime. Although generally successful, the incorporation of recirculation valves within the pump or production tubing may increase pressure losses through the valve. Additionally, the placement of recirculation valves in the discharge flow of submersible pumping systems may cause the accelerated erosion of the recirculation valve from sand and other solid particles present in the high-pressure fluid discharge.

There is, therefore, a continued need for an improved system for re-priming a submersible centrifugal pump. It is to these and other deficiencies in the prior art that the disclosed embodiments are directed.

SUMMARY OF THE INVENTION

In one aspect, the present disclosure is directed to a submersible pumping system for producing a fluid from a wellbore through production tubing to a wellhead. The pumping system includes a pump assembly that has least one pump, a motor that drives the at least one pump, and a recirculation module configured to deliver a volume of priming fluid from the production tubing to the pump assembly. The recirculation module includes a recirculation mandrel positioned within the production tubing, a recirculation valve offset from the recirculation mandrel, and a recirculation line extending from the recirculation valve to the pump assembly.

In another aspect, the present disclosure is directed to a submersible pumping system for producing a fluid from a wellbore through production tubing to a wellhead. The submersible pumping system includes a pump assembly that has at least one pump, a motor that drives the at least one pump, and a recirculation module. The recirculation module includes a recirculation mandrel positioned within the production tubing and a first recirculation line extending to the pump assembly. The recirculation module is configured to deliver a volume of priming fluid from the production tubing to the pump assembly.

In yet another aspect, the present disclosure provides for a submersible pumping system for producing a fluid from a wellbore through production tubing to a wellhead. The pumping system includes a pump assembly that has at least one pump, a motor that drives the at least one pump, and a recirculation module. The recirculation module includes a recirculation mandrel positioned within the production tubing, a first recirculation line, and a second recirculation line. The recirculation module delivers a volume of priming fluid from the production tubing to the pump assembly through the first and second recirculation lines.

WRITTEN DESCRIPTION

As used herein, the term "petroleum" refers broadly to all mineral hydrocarbons, such as crude oil, gas and combinations of oil and gas. The term "two-phase" refers to a fluid that includes a mixture of gases and liquids. It will be appreciated by those of skill in the art that, in the downhole environment, a two-phase fluid may also carry solids and suspensions. Accordingly, as used herein, the term "two-phase" not exclusive of fluids that contain liquids, gases, solids, or other intermediary forms of matter.

Figure 1:
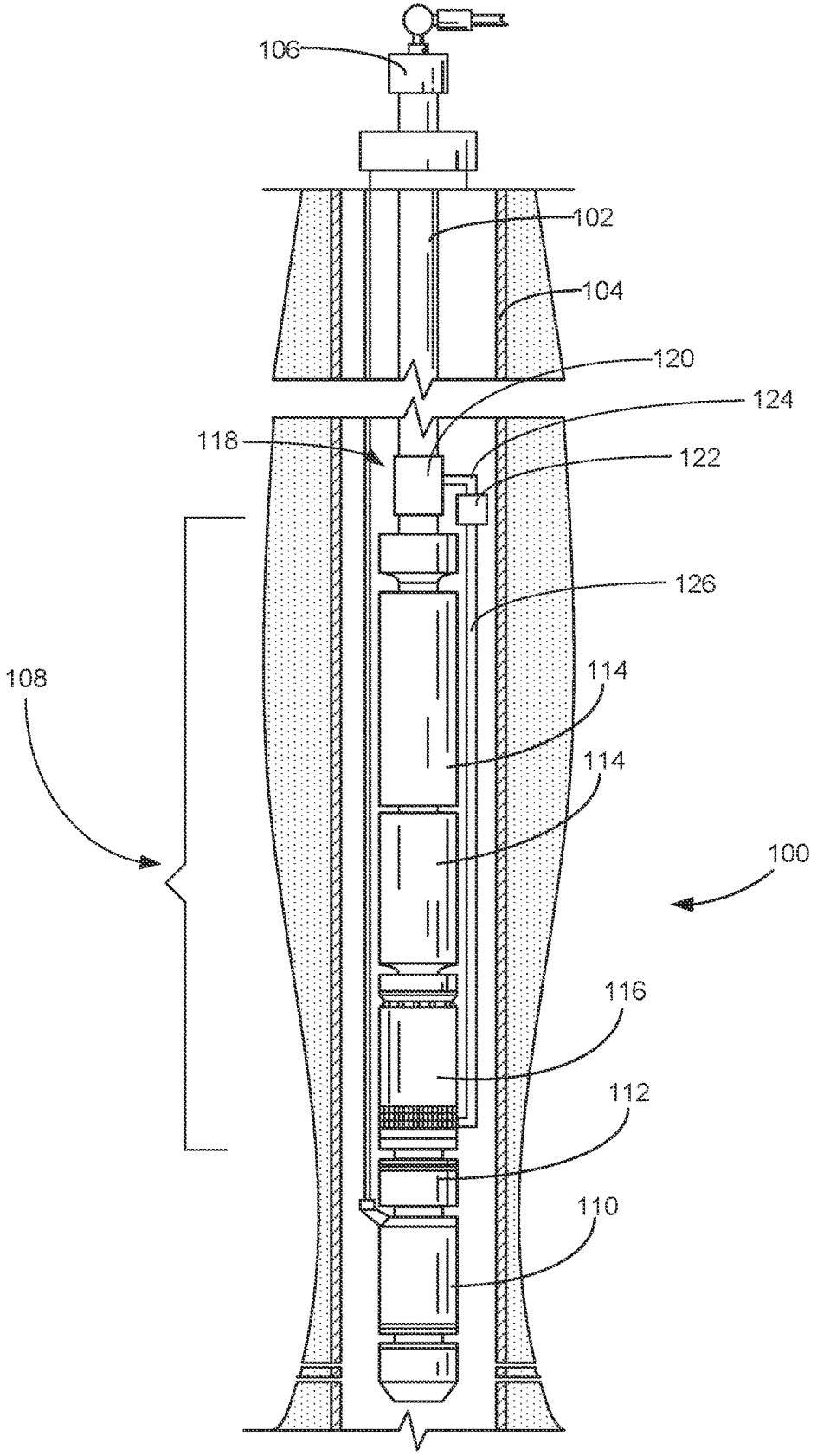
FIG. 1 is an elevational view of an electric submersible pumping system disposed in a wellbore constructed in accordance with an embodiment of the present disclosure.

FIG. 1 shows an elevational view of a pumping system 100 attached to production tubing 102. The pumping system 100 and production tubing 102 are disposed in a wellbore 104, which is drilled for the production of a fluid such as water or petroleum. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations.

For the purposes of the disclosure herein, the terms "upstream" and "downstream" shall be used to refer to the relative positions of components or portions of components with respect to the general flow of fluids produced from the wellbore. "Upstream" refers to a position or component that is passed earlier than a "downstream" position or component as fluid is produced from the wellbore 104. The terms "upstream" and "downstream" are not necessarily dependent on the relative vertical orientation of a component or position. It will be appreciated that many of the components in the pumping system 100 are substantially cylindrical and have a common longitudinal axis that extends through the center of the elongated cylinder and a radius extending from the longitudinal axis to an outer circumference. Objects and motion may be described in terms of radial positions within discrete components in the pumping system 100.

The pumping system 100 includes some combination of a pump assembly 108, a motor 110, and a seal section 112. The seal section 112 shields the motor 110 from mechanical thrust produced by the pump assembly 108 and provides for the expansion of motor lubricants during operation. As illustrated in FIG. 1, the pump assembly 108 may include two or more separate pumps 114 that are each connected to one another. In the embodiment depicted in FIG. 1, the pump assembly 108 includes a plurality of multistage centrifugal pumps 114*a*, 114*b* connected together in a serial (end-to-end) relationship.

The pump assembly 108 optionally includes a gas separator 116 positioned upstream from the pumps 114. The gas separator 116 can be connected between the seal section 112 and the first (upstream) pump 114. During use, two-phase wellbore fluids are drawn into the gas separator 116, which encourages the separation of gaseous components from the liquid components. The gaseous components are ejected into the annulus of the wellbore 104, while the liquid components are carried to the first pump 114 in the pump assembly 108. It will be understood that the components of the gas separator 116 may be integrated into one of the pumps 114 rather than presented as a separate component. It will be further understood that in certain embodiments, the pump assembly 108 may include multiple gas separators 116, which may be connected together in a tandem configuration.

The pumping system 100 also includes a recirculation module 118 between the discharge of the downstream pump 114 and the production tubing 102. In some embodiments, the recirculation module 118 includes a recirculation mandrel 120, a recirculation valve 122, a recirculation valve inlet 124 and a recirculation line 126. Generally, the recirculation valve 122 is configured to automatically open when a gas lock condition occurs (e.g., in the pump assembly 108) to provide a volume of liquid to re-prime the affected component of the pump assembly 108. The recirculation valve 122 can be configured as a standard check valve that includes a moveable valve member 122*a* that is biased in a closed position against a valve seat 122*b* by a biasing element 122*c*, such as a spring 122*c*. When the pressure supplied by the pump assembly 108 drops below a threshold established by the biasing element 122*c*, the recirculation valve opens 122, permitting liquid from the production tubing 102 to pass through the recirculation valve 122 to the recirculation line 126, which delivers the liquid necessary to re-prime the pump assembly 108.

Importantly, the recirculation valve 122 is positioned adjacent to the primary flow path between the pump assembly 108 and the production tubing 102. Removing the recirculation valve 122 from the primary flow path for the produced fluids reduces the pressure drop that would otherwise be caused by the placement of a diverter valve in this location.

As explained below, the recirculation module 118 can be configured in a variety of embodiments to better control the placement of fluid from the recirculation module 118 into the appropriate component within the pump assembly 108. Although the recirculation line 126 depicted in FIG. 1 shows a discharge of priming fluid from the recirculation module 118 to an intake of the gas separator 116, it will be appreciated that the depiction of the pumping system 100 in FIG. 1 is merely exemplary and should not be construed as a limiting embodiment. In some embodiments, multiple recirculation lines 126 are used to convey priming fluid to the same or different parts of the pump assembly 108. As used in this application, the term "priming fluid" refers to fluid directed by the recirculation module 118 from the production tubing to the pump assembly 108.

Figure 2:
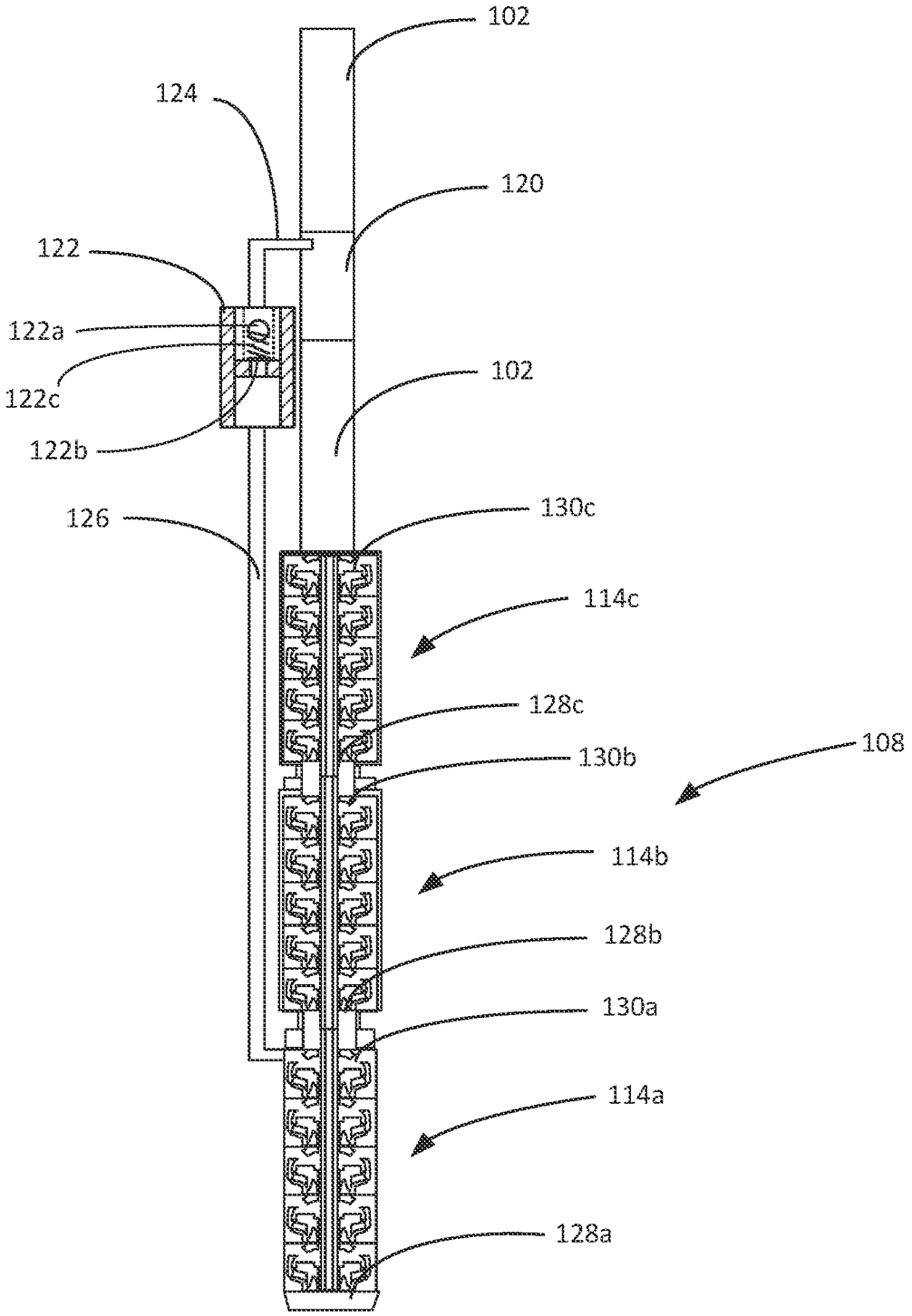
FIG. 2 provides a cross-sectional depiction of a first embodiment of the recirculation assembly connected to a submersible pump assembly.

Turning to FIG. 2, shown therein is a first embodiment in which the recirculation module 118 is connected within the pumping system 100. In this embodiment, the pump assembly 108 includes three pumps 114*a*, 114*b*, 114*c* that are connected together in a serial manner. Each pump 114 includes an intake 128 and a discharge 130. The intake 128 can be configured to receive fluid from the wellbore 104, or from the discharge 130 from an upstream pump 114.

In the embodiment depicted in FIG. 2, the recirculation mandrel 120 is located between joints of the production tubing 102, above (or downstream) from the pump assembly 108. In this embodiment, the recirculation line 126 of the recirculation module 118 is configured to discharge fluid between the discharge 130*a* of the upstream pump 114*a* and the intake 128*b* of the intermediate pump 114*b*. In this way, when the recirculation valve 122 opens, produced fluids from the production tubing 102 are directed to the intake 128*b* of the intermediate pump 114*b* to re-prime the pump assembly 108.

Figure 3:
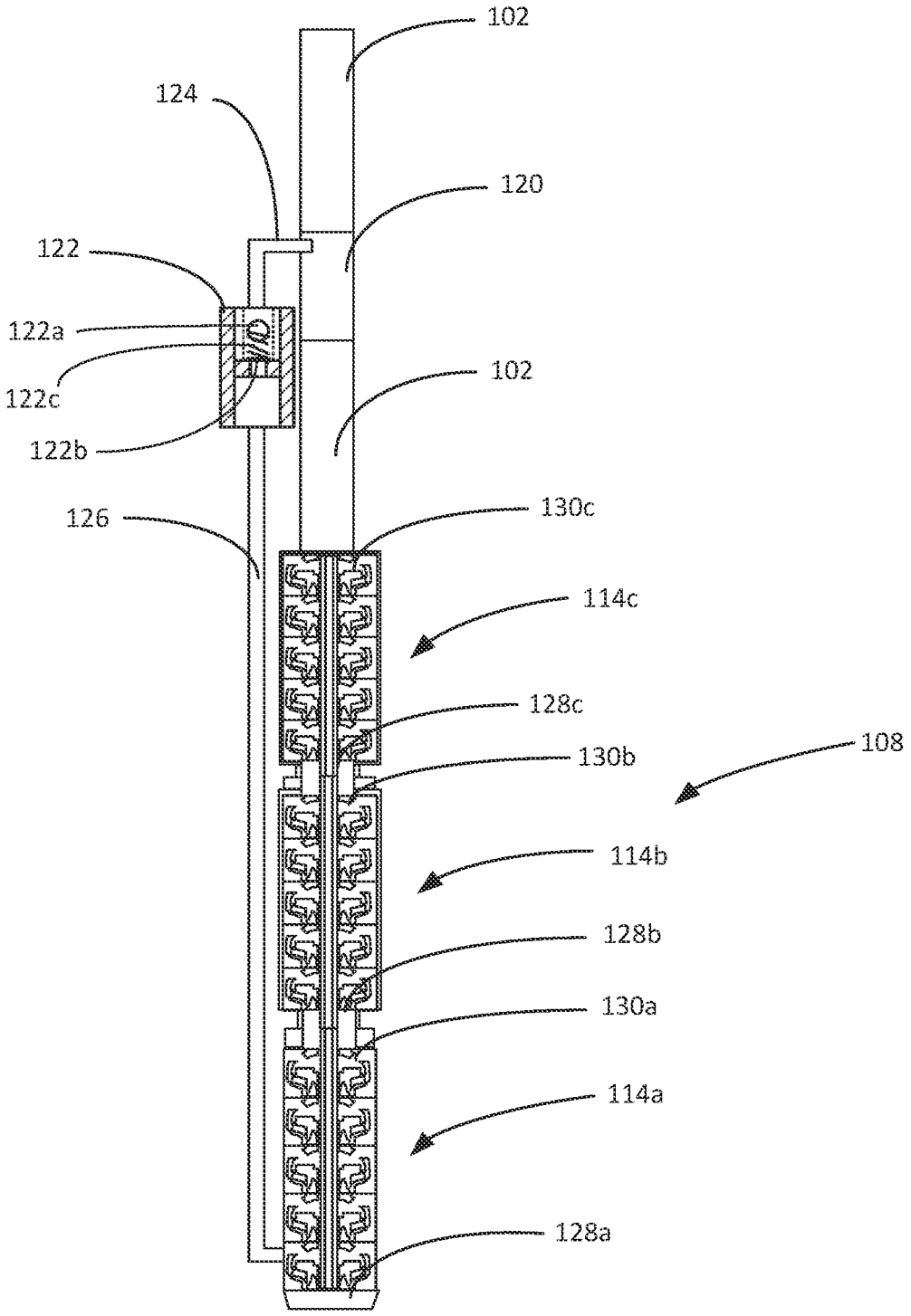
FIG. 3 provides a cross-sectional depiction of a second embodiment of the recirculation assembly connected to a submersible pump assembly.

Turning to FIG. 3, shown therein is a second embodiment in which the recirculation module 118 is connected within the pumping system 100 such that the recirculation line 126 is connected to the pump assembly 108 a location downstream from the first pressure-inducing stage. For example, the recirculation line 126 can be connected to the outlet of the first (upstream) impeller of the upstream pump 114*a*. Alternatively, the recirculation line 126 can be connected to a downstream side of the gas separator 116 if the gas separator 116 is present in the pumping system 100.

Figure 4:
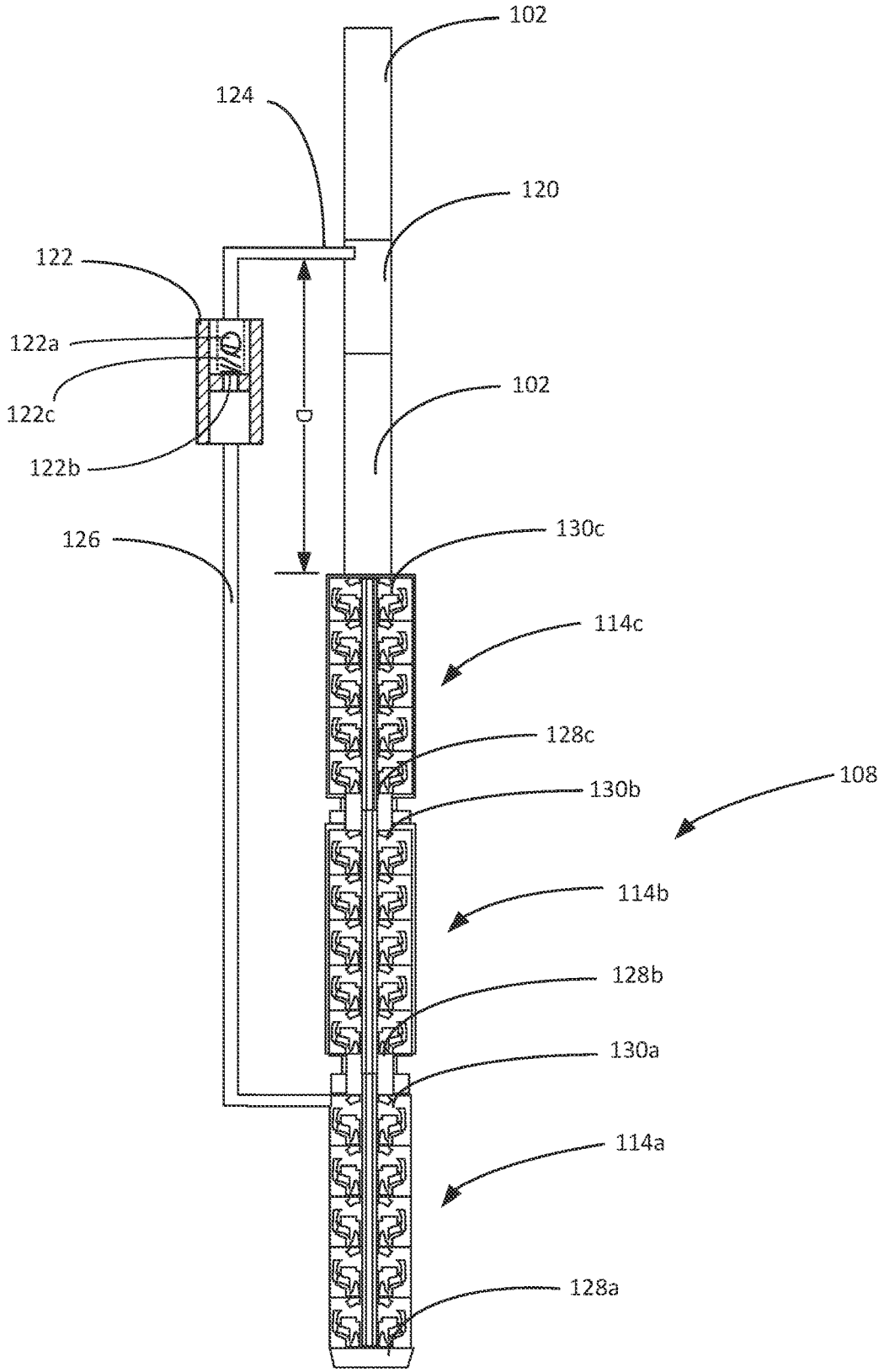
FIG. 4 provides a cross-sectional depiction of a third embodiment of the recirculation assembly connected to a submersible pump assembly.

Turning to FIG. 4, shown therein is a third embodiment in which the recirculation module 118 is connected within the pumping system 100 such that the recirculation mandrel 120 is located within the production tubing 102 at a distance (D) downstream from the pump assembly 108 that is selected to minimize the adverse effects caused by abrasive particulates entrained in the produced, high-pressure fluid. In some embodiments, the distance (D) is greater than the length of the pump assembly 108. In other embodiments, the distance (D) is about the same as the length of the pump assembly 108, about half the length of the pump assembly, about one-quarter the length of the pump assembly 108, or less than one-quarter the length of the pump assembly 108.

Figure 5:
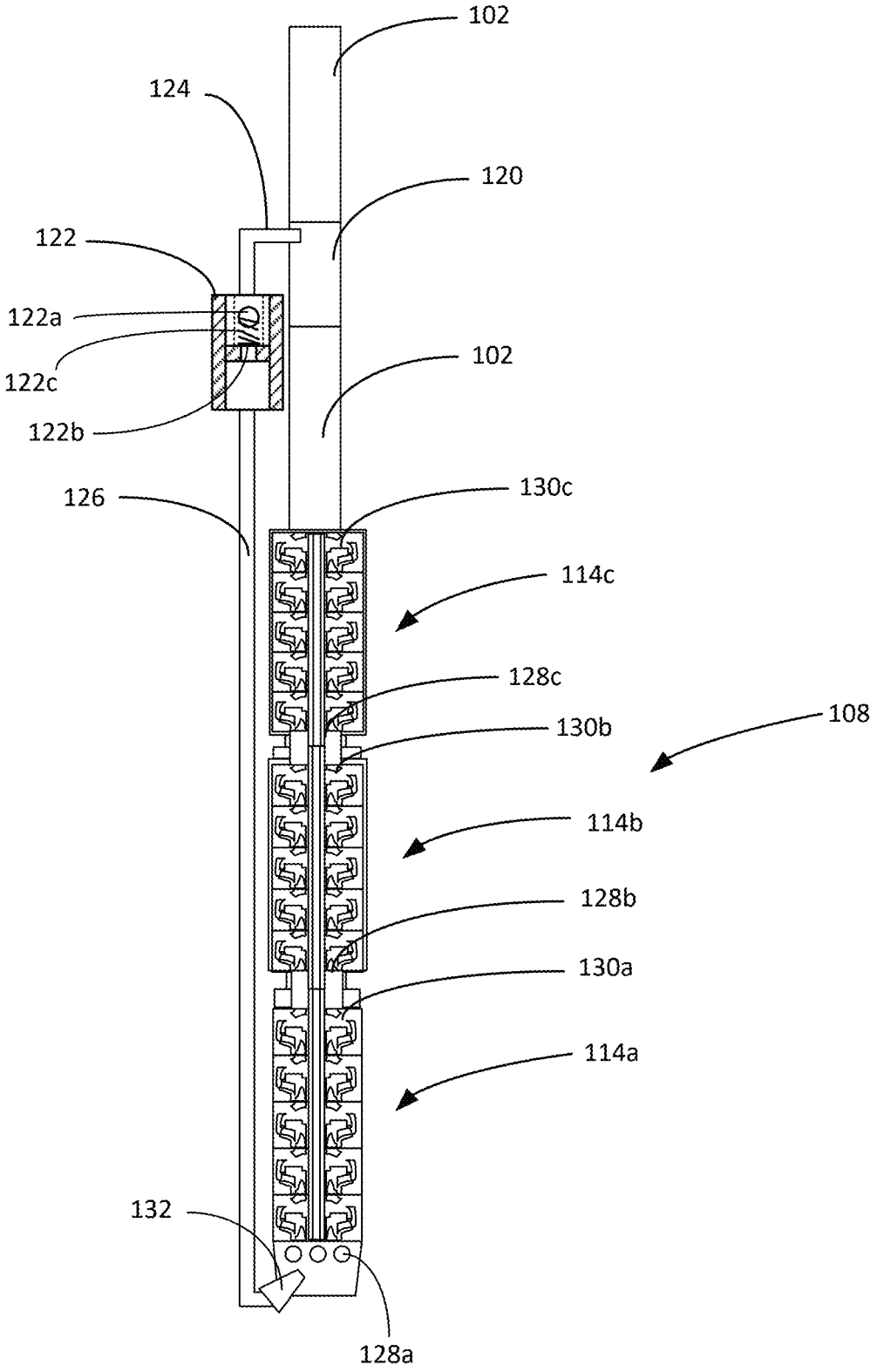
FIG. 5 provides a cross-sectional depiction of a fourth embodiment of the recirculation assembly connected to a submersible pump assembly.

Turning to FIG. 5, shown therein is a fourth embodiment in which the recirculation module 118 includes a directional nozzle 132 that controls the flow of priming fluid into the pump assembly 108. In exemplary embodiments, the directional nozzle 132 can be a bent or angled tubing that injects the priming fluid from the recirculation module 118 into the pump assembly 108 in a manner that encourages the flow of fluid into, and along a common path with, fluid entering the pump assembly 108 from the wellbore 104.

Figure 6:
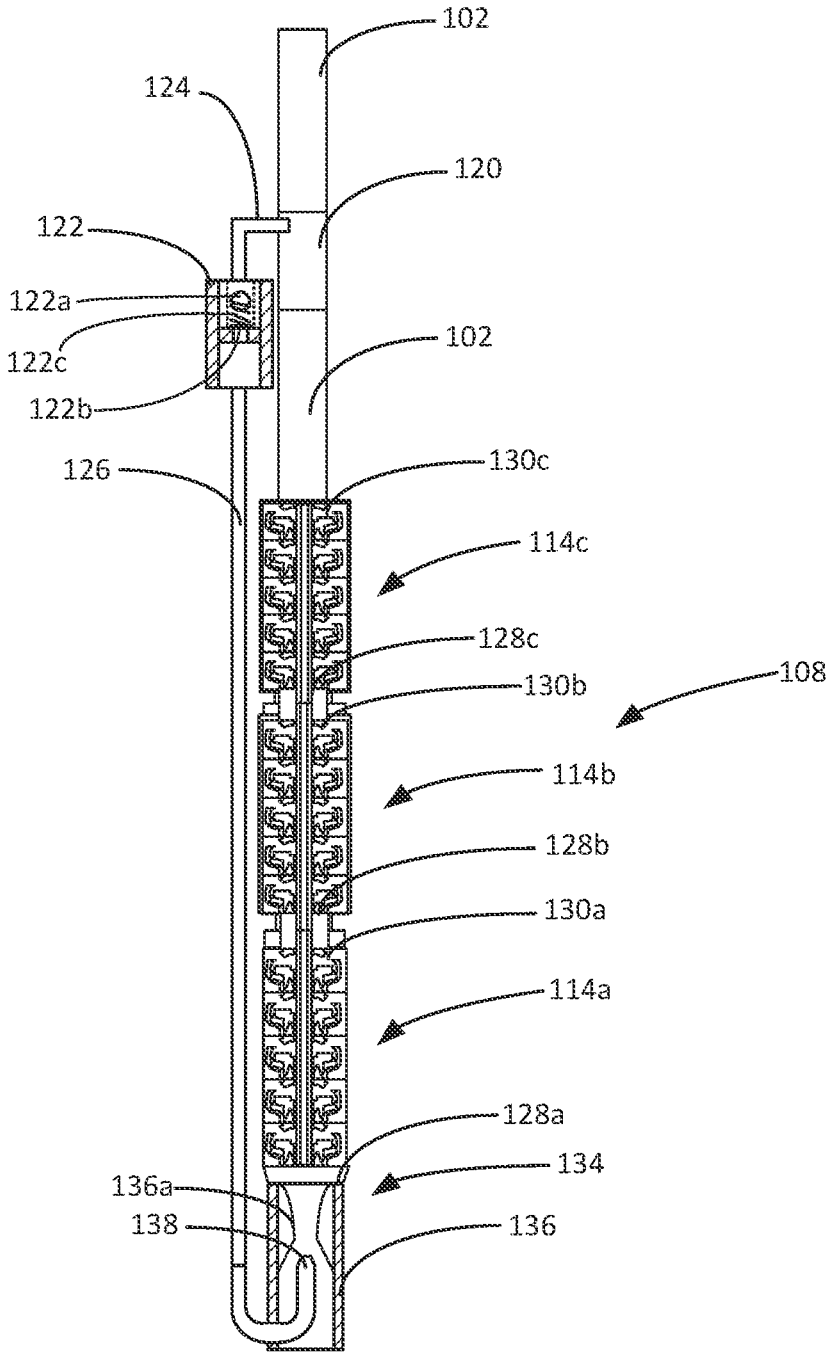
FIG. 6 provides a cross-sectional depiction of a fifth embodiment of the recirculation assembly connected to a submersible pump assembly.

Turning to FIG. 6, shown therein is a fifth embodiment in which the recirculation module 118 includes an eductor assembly 134 for passing the priming fluid into the pump assembly 108. The eductor assembly 134 includes an eductor housing 136 is connected to, or integral with, the 128*a* of the upstream pump 114*a*. The eductor housing 136 can include a tapered internal profile with a throat 136*a* that encourages the acceleration of fluid passing through the eductor housing 136. In other embodiments, the eductor housing 136 could be connected to, or made integral with, another component within the pump assembly 108. The eductor assembly 134 includes an eductor discharge 138 that is connected to the recirculation line 126. The eductor discharge 138 is coaxial with the eductor housing 136. In this way, the priming fluid injected into the eductor housing 136 creates a jet-induced low pressure region within the eductor housing 136 that encourages fluids from the wellbore 104 to be drawn into the pump assembly 108 according to the Venturi principle. The accelerated priming fluid better mixes with any gases in the wellbore fluid to mitigate large bubbles or pockets of gas that might otherwise contribute to a gas locked condition.

Additionally, the discharge of priming fluid from the eductor assembly 134 is also directed into the center of the pump assembly 108, which aids in the cooling of the shaft bearings in the pump assembly 108. When the pump assembly 108 loses prime, the wellbore fluids that would ordinarily cool and lubricate tungsten carbide and other bearings in the pump assembly 108 are not present, which can lead to the accelerated wear and thermal shock of these bearing components. In this way, the eductor assembly 134 applies a Venturi pumping action that also provides a cooling and lubricating function to the tungsten carbide bearings within the pump assembly 108.

Figure 7A:
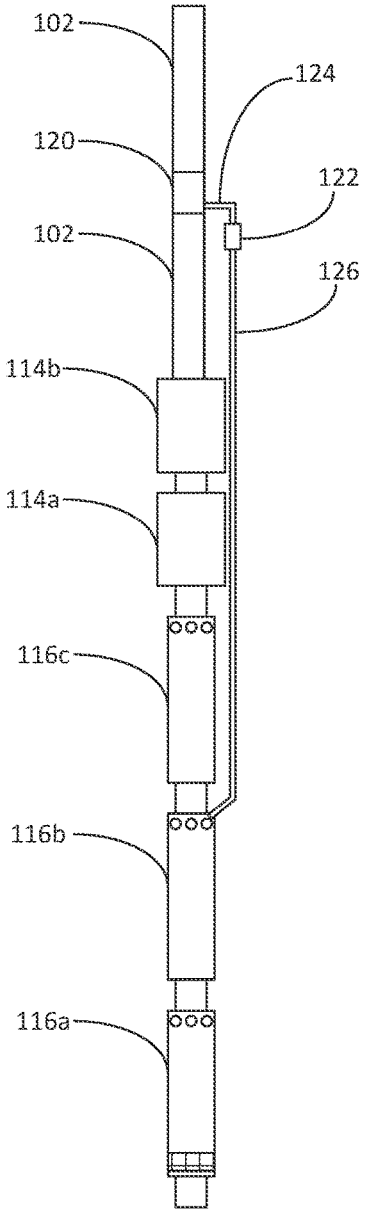
FIG. 7A-7C provide depictions of additional configurations of the recirculation assembly connected to a submersible pumping system.
Figure 7B:
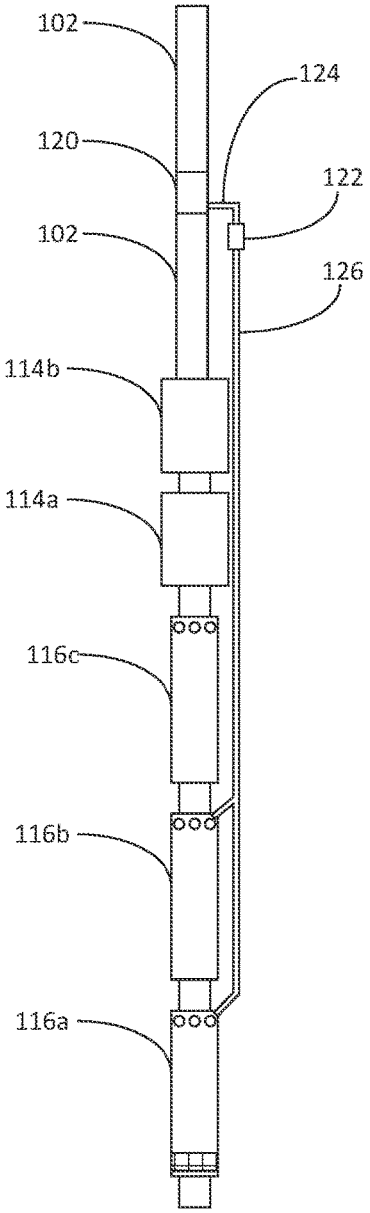
Figure 7C:
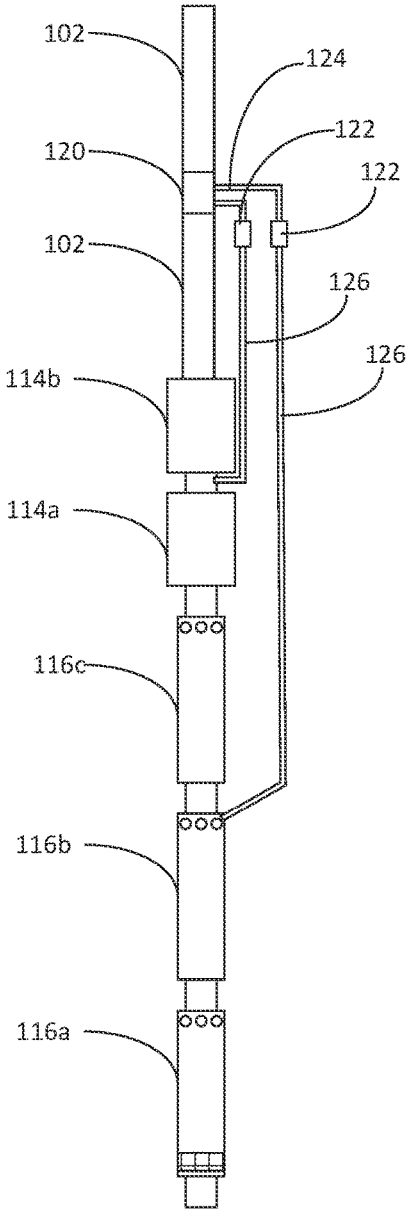

Turning to FIGS. 7A-7C, shown therein are additional embodiments in which the recirculation module 118 is connected to the pump assembly 108. In FIG. 7A, the recirculation line 126 is connected between the optional recirculation valve 122 and the discharge portion of a middle gas separator 116*b* connected between upstream and downstream gas separators 116*a*, 116*b* connected in a tandem configuration. In FIG. 7B, the recirculation line 126 branches between the optional recirculation valve 122 and the discharge side of the middle and upstream gas separators 116*b*, 116*a* which again are connected in tandem. FIG. 7C depicts yet another embodiment in which two separate recirculation lines 126 are connected between the pump assembly 108 and corresponding recirculation valves 122, which are also optional in this embodiment. The first recirculation line 126 connects between an upstream pump 114*a* and a downstream pump 114*b*. The second recirculation line connects between the optional recirculation valve 122 and the discharge end of the middle gas separator 116*b*.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, in some embodiments, it may be possible to omit the recirculation valve 122, or integrate it into the recirculation mandrel 120. It will be appreciated by those skilled in the art that the teachings of the present invention can be applied to other systems without departing from the scope and spirit of the present invention.

What is claimed is:

1. A submersible pumping system for producing a fluid from a wellbore through production tubing to a wellhead, the pumping system comprising:

a pump assembly, wherein the pump assembly comprises:
- at least one pump; and
- a gas separator connected to the pump, wherein the gas separator includes an intake;

a motor that drives the at least one pump; and a recirculation module configured to deliver a volume of priming fluid from the production tubing to the pump assembly, wherein the recirculation module comprises:
- a recirculation mandrel positioned within the production tubing;
- a recirculation valve offset from the recirculation mandrel, wherein the recirculation valve comprises a biasing element configured to automatically open the recirculation valve when the pressure supplied by the pump assembly drops below a threshold pressure indicative of a gas lock condition in the pump assembly; and
- a recirculation line extending from the recirculation valve to the intake of the gas separator.

2. A submersible pumping system for producing a fluid from a wellbore through production tubing to a wellhead, the pumping system comprising:

a pump assembly, wherein the pump assembly comprises at least one pump;

a motor that drives the at least one pump; and a recirculation module, wherein the recirculation module comprises:
- a recirculation mandrel positioned within the production tubing;
- a recirculation valve, wherein the recirculation valve comprises a biasing element configured to automatically open the recirculation valve when the pressure supplied by the pump assembly drops below a threshold pressure indicative of a gas lock condition in the pump assembly; and
- a first recirculation line extending to the pump assembly; and wherein the recirculation module delivers a volume of priming fluid from the production tubing to the pump assembly.

3. The submersible pumping system of claim 2, wherein the recirculation valve is offset from the recirculation mandrel.

4. A submersible pumping system for producing a fluid from a wellbore through production tubing to a wellhead, the pumping system comprising:

a pump assembly, wherein the pump assembly comprises at least one pump;

a motor that drives the at least one pump; and a recirculation module, wherein the recirculation module comprises:

a recirculation mandrel positioned within the production tubing;

a recirculation valve, wherein the recirculation valve comprises a biasing element configured to automatically open the recirculation valve when the pressure supplied by the pump assembly drops below a threshold pressure indicative of a gas lock condition in the pump assembly;

a first recirculation line; and a second recirculation line wherein the recirculation module delivers a volume of priming fluid from the production tubing to the pump assembly through the first and second recirculation lines.

* * * * *